US006343530B1

(12) United States Patent
Huang

(10) Patent No.: US 6,343,530 B1
(45) Date of Patent: Feb. 5, 2002

(54) FAST ADJUSTABLE WRENCH

(76) Inventor: Pin Wen Huang, 1F, No. 364, Sec. 2 Chung-yang Road, Hsien-Hsi Tsun, Chang Hua Hsien (TW)

( * ) Notice: Subject to any disclaimer, the term of this patent is extended or adjusted under 35 U.S.C. 154(b) by 0 days.

(21) Appl. No.: 09/729,186

(22) Filed: Dec. 5, 2000

(51) Int. Cl.[7] ..... B25B 13/46
(52) U.S. Cl. ..... 81/57.39; 81/58.4; 81/60
(58) Field of Search ..... 81/58.1, 58.4, 81/57.39, 60

(56) References Cited

U.S. PATENT DOCUMENTS 4,031,785 A * 6/1977 Wheeler ..... 81/57.39
4,108,027 A * 8/1978 Lenker ..... 81/57.39 X
4,339,969 A * 7/1982 Hage ..... 81/57.39
4,425,828 A * 1/1984 Berdinner ..... 81/57.39
5,309,796 A * 5/1994 Jones ..... 81/57.39

* cited by examiner

*Primary Examiner*—James G. Smith
(74) *Attorney, Agent, or Firm*—Rosenberg, Klein & Lee

(57) ABSTRACT

A Fast adjustable wrench including a main body and a trigger seat pivotally disposed in the main body and driven by a trigger. The trigger seat can be switched to push an upper link or a lower link. When pulling the trigger, the trigger seat is driven to move forward to push the upper link or lower link forward. The upper or lower link at this time pushes and rotates a rotary member which is disposed at front end of the main body and fitted with a nut or a bolt head. Therefore, the nut or bolt head can be fast wrenched.

2 Claims, 4 Drawing Sheets

FAST ADJUSTABLE WRENCH

BACKGROUND OF THE INVENTION

The present invention relates to a fast adjustable wrench which is able to fast wrench a nut of a bolt head in a narrow space.

A conventional wrench has an elongated handle one end of which is formed with a socket for fitting with a nut or the head of a bolt. In use, a user needs to turn the elongated handle to wrench the nut or bolt. The larger the wrenching amplitude is, the quicker the nut or bolt is wrenched. In the case that the nut or bolt is positioned in a narrow space as shown in FIG. 5, it will be quite troublesome and time-consuming to wrench the nut or bolt with the wrench in the limited space.

SUMMARY OF THE INVENTION

It is therefore a primary object of the present invention to provide a fast adjustable wrench including a main body and a trigger seat pivotally disposed in the main body and driven by a trigger. By means of pulling the trigger, the trigger seat is driven to move forward to push an upper link or a lower link forward. The upper or lower link pushes and rotates a rotary member which is disposed at front end of the main body and fitted with a nut or a bolt head. Therefore, the nut or bolt head -can be fast wrenched in a narrow space.

The present invention can be best understood through the following description and accompanying drawings wherein:

DETAILED DESCRIPTION OF THE PREFERRED EMBODIMENT

Figure 1:
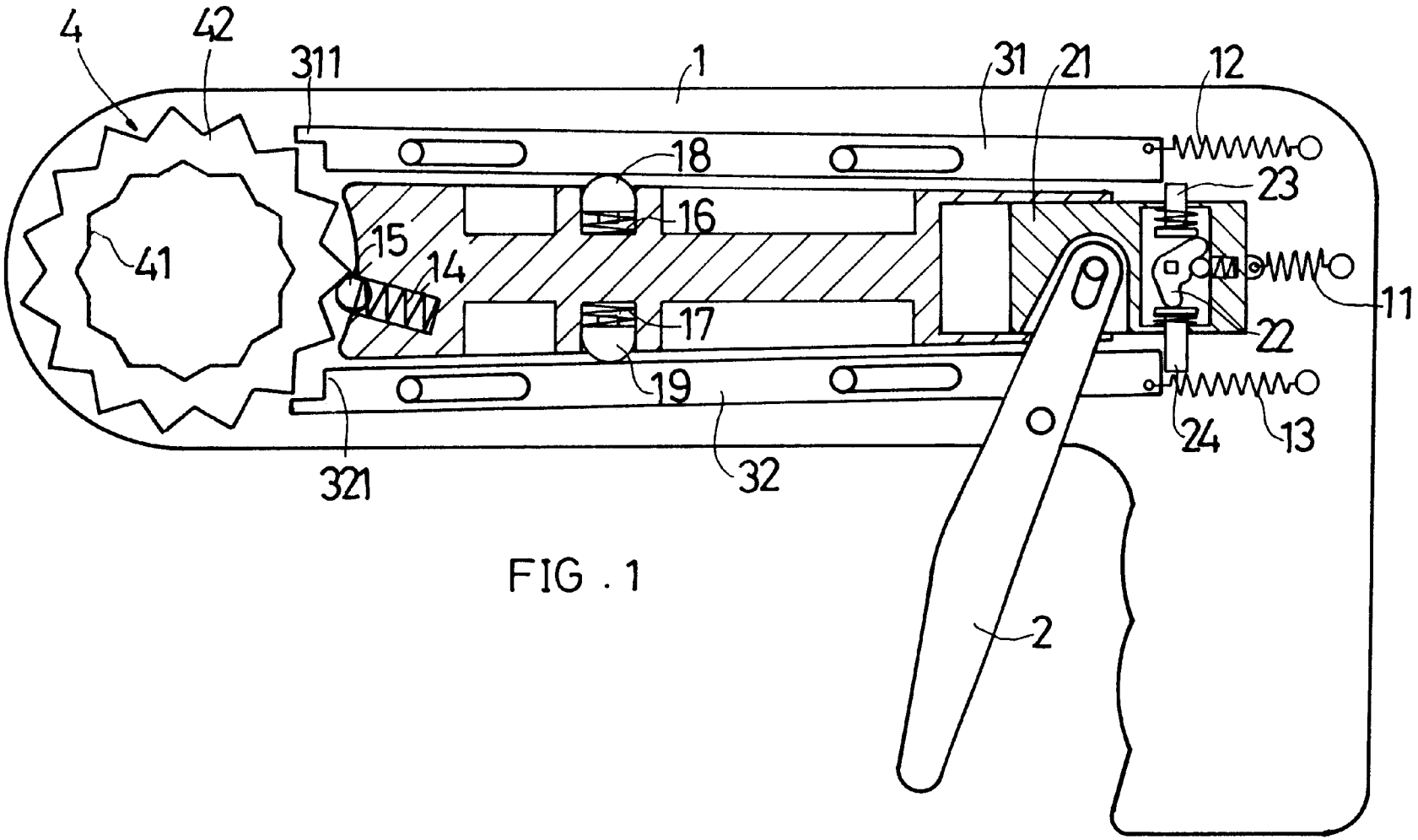
FIG. 1 is a sectional view showing the structure of the fast adjustable wrench of the present invention.
Figure 2:
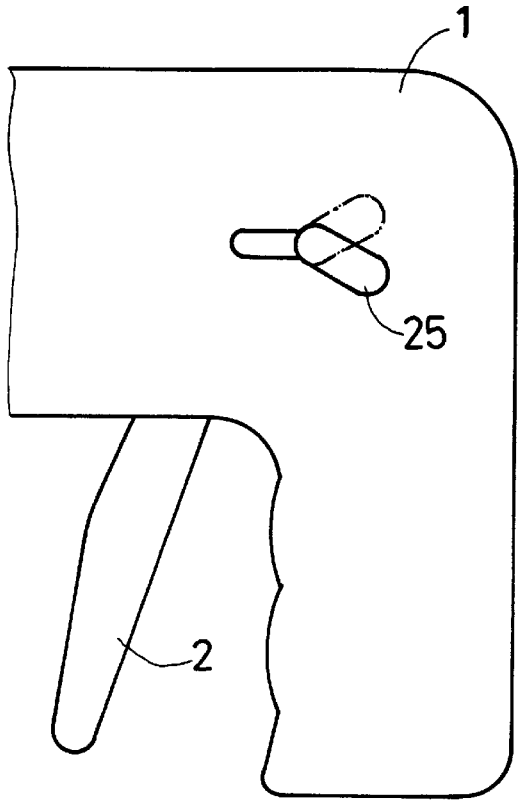
FIG. 2 is a side view of a part of the fast adjustable wrench of the present invention, showing the switch section thereof.
Figure 3:
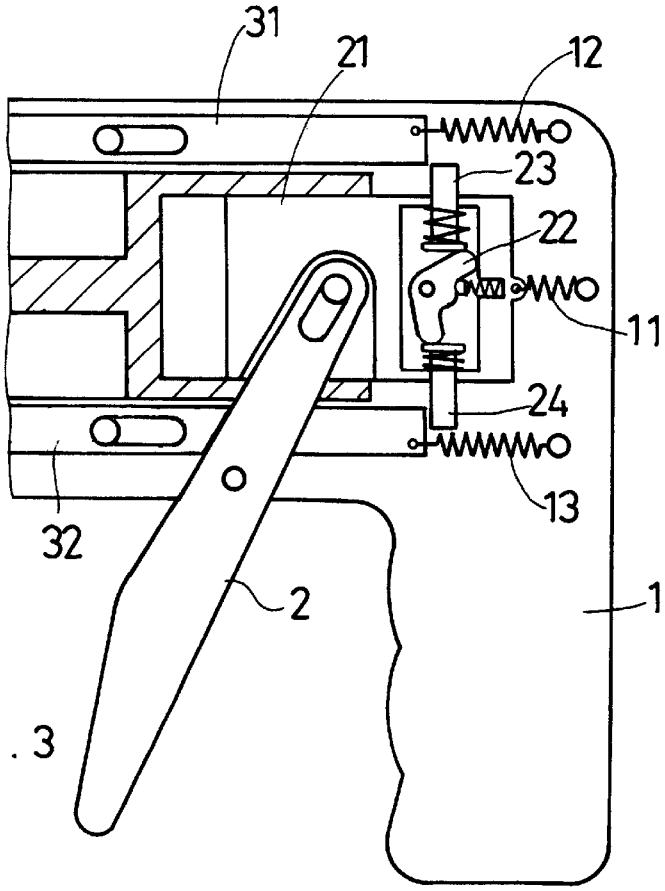
FIG. 3 is a sectional view of the trigger seat of the fast adjustable wrench of the present invention.

Please refer to FIGS. 1 to 3. The fast adjustable wrench of the present invention includes a main body 1 and a trigger 2 pivotally disposed in the main body 1. A trigger seat 21 is pivotally connected with one end of the trigger 2 inside the main body 1. The trigger seat 21 is back and forth slidably disposed in the main body 1. A first spring 11 is connected between the main body 1 and the trigger seat 21. In normal state, the first spring 11 pulls the trigger seat 21 backward. An upper and a lower links 31, 32 are back and forth slidably disposed on upper and lower sides of the trigger seat 21. A second and a third springs 12, 13 are respectively connected between the rear ends of the upper and lower links 31, 32 and the main body 1. The second and third springs 12, 13 pull the upper and lower links 31, 32 backward in normal state. A swinging member 22 is pivotally disposed in the trigger seat 21. An upper and a lower push pins 23, 24 are respectively disposed on upper and lower sides of the swinging member 22. The swinging member 22 serves to push the upper and lower push pins 23, 24 to extend out of the trigger seat 21. When the trigger seat 21 is moved back and forth, the upper and lower push pins 23, 24 can push the rear ends of the upper and lower links 31, 32 to move the upper and lower links 31, 32 back and forth. The swinging member 22 has a switch section 25 extending out of the main body 1 for switching the swinging member 22. A rotary member 4 is rotatably disposed at front section of the main body 1. The rotary member 4 is formed with a central plum blossom-shaped hole 41 for fitting with a nut or a bolt head. The outer circumference of the rotary member 4 is formed with multiple teeth 42. The front ends of the upper and lower links 31, 32 are respectively formed with toothed sections 311, 321 corresponding to the teeth 42 of the rotary member 4. When the upper and lower links 31, 32 are moved forward, the toothed sections 311, 321 can push and rotate the rotary member 4. A locating steel ball 15 is disposed in the main body 1 corresponding to the teeth 42 of the rotary member 4. The steel ball 15 is pushed by a fourth spring 14 to locate the rotary member 4. In addition, an upper and a lower press members 18, 19 are respectively positioned on lower side of the upper link 31 and the upper side of the lower link 32. The upper and lower press members 18, 19 are respectively pushed by a fifth and a sixth springs 16, 17 in normal state to respectively push the bottom face of the upper link 31 and the top face of the lower Link 32.

Figure 4:
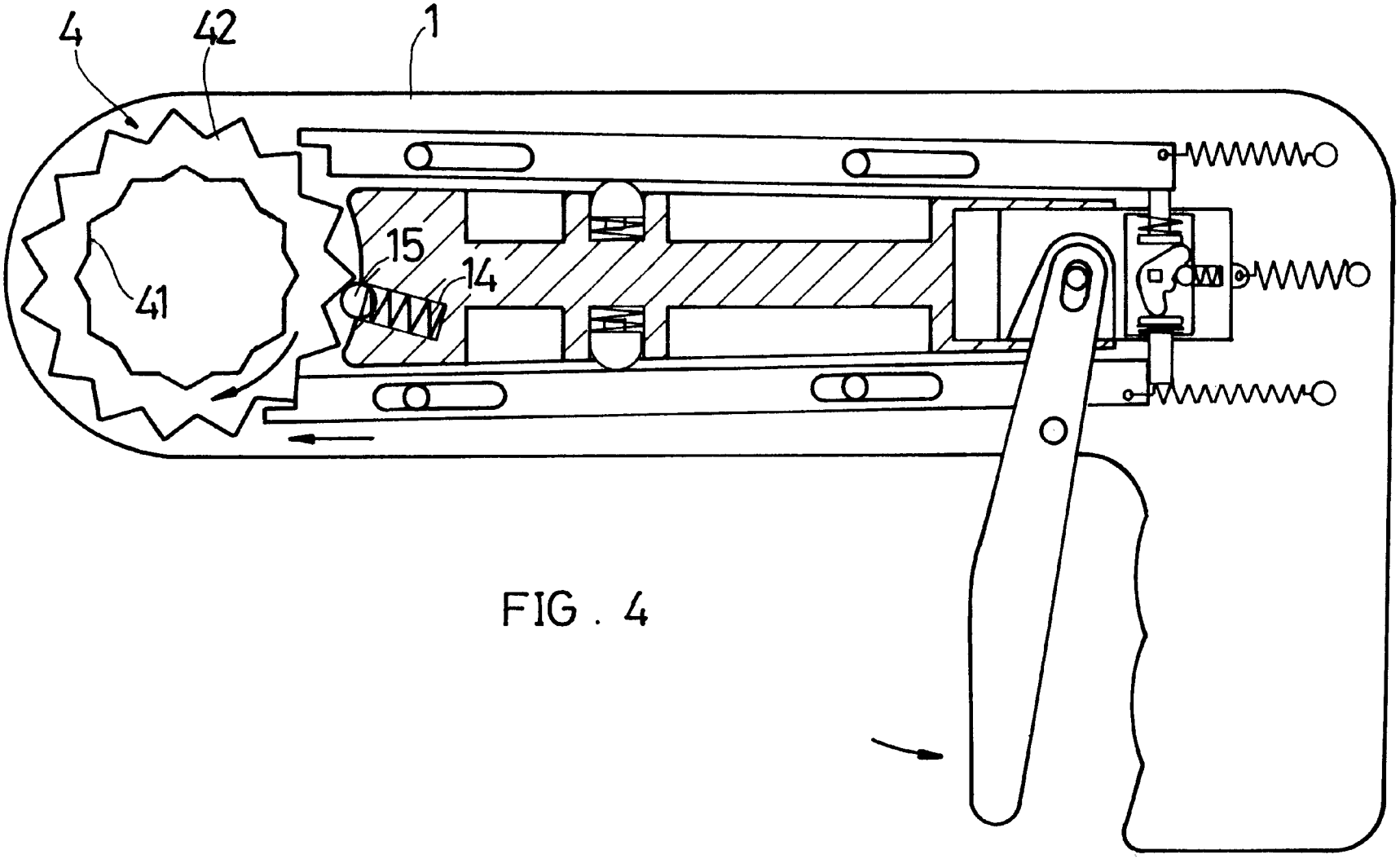
FIG. 4 is a sectional view of the fast adjustable wrench of the present invention, showing that the trigger is pulled to rotate the rotary member.
Figure 5:
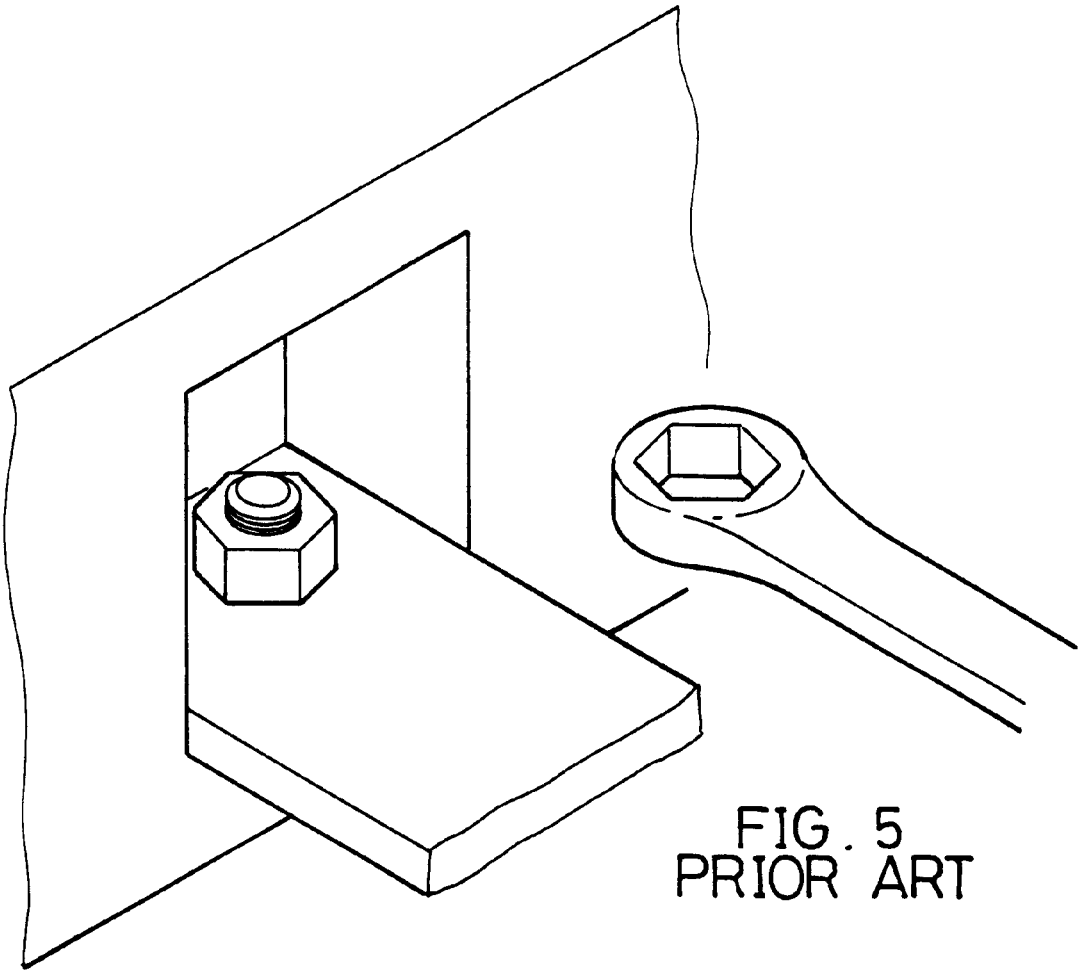
FIG. 5 PRIOR ART
FIG. 5 shows the use of a conventional wrench.

Referring to FIG. 4, in use, the rotary member 4 with the plum blossom-shaped hole 41 is fitted with a nut or a bolt head. Then the switch section 25 of the swinging member 22 is rotated to switch the swinging member 22 to push the upper push pin 23 or the lower push pin 24 to extend out of the trigger seat 21. Then the trigger 2 is pulled to drive the trigger seat 21 to move forward. At this time, the upper push pin 23 or the lower push pin 24 pushes the upper link 31 or the lower link 32 to move forward. The toothed section 311 or 312 of the front end of the upper link 31 or the lower link 32 will push the teeth 42 of the rotary member 4 to rotate the same. At this time, the rotary member 4 drivingly wrenches the nut or bolt. When the trigger 2 is released, the trigger seat 21 and the upper link 31 or lower link 32 is pulled back to their home positions by the first spring 11 and second or third spring 12, 13. The operation is repeated to fast wrench the nut or bolt head in a narrow space.

The above embodiment is only used to illustrate the present invention, not intended to limit the scope thereof. Many modifications of the above embodiment can be made without departing from the spirit of the present invention.

What is claimed is:

1. A Fast adjustable wrench comprising a main body and a trigger pivotally disposed in the main body, a trigger seat being pivotally connected with one end of the trigger inside the main body, the trigger seat being back and forth slidably disposed in the main body, a first spring being connected between the main body and the trigger seat, in normal state, the first spring pulling the trigger seat backward, an upper and a lower links being back and forth slidably disposed on upper and lower sides of the trigger seat, a second and a third springs being respectively connected between the rear ends of the upper and lower links and the main body, the second and third springs pulling the upper and lower links backward in normal state, a swinging member being pivotally disposed in the trigger seat, an upper and a lower push pins being respectively disposed on upper and lower sides of the swinging member, the swinging member serving to push the upper and lower push pins to extend out of the trigger seat, when the trigger seat is moved back and forth, the upper and lower push pins pushing the upper and lower links to move back and forth, the swinging member having a switch section extending out of the main body for switching the swinging member, a rotary member being rotatably disposed at front section of the main body, the rotary member being formed with a central plum blossom-shaped hole for fitting with a nut or a bolt head, an outer circumference of the rotary member being formed with multiple teeth, front ends of the upper and lower links being respectively formed with toothed sections corresponding to the teeth of the rotary member, whereby when the upper and lower links are moved forward, the toothed sections can push and rotate the rotary member, a locating steel ball being disposed in the main body corresponding to the teeth of the rotary member, the steel ball being pushed by a fourth spring to locate the rotary member.

2. A Fast adjustable wrench as claimed in claim 1, wherein an upper and a lower press members are respectively positioned on lower side of the upper link and the upper side of the lower link, the upper and lower press members being respectively pushed by a fifth and a sixth springs in normal state to respectively push a bottom face of the upper link and a top face of the lower link.

* * * * *